US005638707A

United States Patent [19]

Gould

[11] Patent Number: 5,638,707

[45] Date of Patent: Jun. 17, 1997

[54] PROTECTIVE COVER FOR A LOCK BOX

[76] Inventor: Murray J. Gould, 11712 Silent Valley La., Gaithersburg, Md. 20878

[21] Appl. No.: 580,374

[22] Filed: Dec. 28, 1995

[51] Int. Cl.[6] ..... E05B 67/38

[52] U.S. Cl. ..... 70/56; 70/63; 70/54; 40/649

[58] Field of Search ..... 70/54–56, 63; 40/124.2, 124.4, 310, 331, 617, 642, 649

[56] References Cited

U.S. PATENT DOCUMENTS

| | | | |
|---|---|---|---|
| 858,264 | 6/1907 | Daugherty | 70/55 |
| 1,244,404 | 10/1917 | Ankovitz | 70/56 |
| 1,581,953 | 4/1926 | Jackson | 70/55 |
| 2,315,158 | 3/1943 | Markham | 70/63 X |
| 2,828,157 | 3/1958 | Fox et al. | 70/55 X |
| 4,134,280 | 1/1979 | Pelavin | 70/55 |
| 4,509,277 | 4/1985 | Bolton | 40/649 X |
| 4,819,465 | 4/1989 | Stanich | 70/56 |
| 4,869,082 | 9/1989 | Appelbaum | 70/63 |
| 4,897,945 | 2/1990 | Webb | 40/649 X |
| 4,937,963 | 7/1990 | Barnes | 40/642 |
| 5,003,795 | 4/1991 | Hoke | 70/55 |
| 5,022,170 | 6/1991 | House | 40/649 X |
| 5,046,339 | 9/1991 | Krell | 70/63 X |
| 5,092,062 | 3/1992 | Palka | 40/124.4 X |
| 5,218,846 | 6/1993 | Cook et al. | 70/56 |
| 5,275,028 | 1/1994 | Giarrante | 70/56 |
| 5,460,020 | 10/1995 | Hungerford | 70/63 |

FOREIGN PATENT DOCUMENTS

| | | | |
|---|---|---|---|
| 92884 | 5/1923 | Austria | 70/54 |

OTHER PUBLICATIONS

Popular Science, Aug. 1960, p. 159, Rubber Shield for Padlocks.

*Primary Examiner*—Suzanne Dino
*Attorney, Agent, or Firm*—Longacre & White

[57] ABSTRACT

A protective covering is formed to hang from a realtor's lock box in such a manner that the U-shaped shackle passes through a mid-portion of the covering, and two hanging flaps extend from this mid-portion to hang on opposite sides of the lock box. The forward flap which extends away from the door is preferably provided with at least one window region to receive a realtor's business card, or for posting messages. The rear flap is interposed between the lock-box and the door to protect the door from abrasion.

12 Claims, 4 Drawing Sheets

PROTECTIVE COVER FOR A LOCK BOX

BACKGROUND OF THE INVENTION a) Field of the Invention

This invention relates to a protective covering, especially for protecting and covering a realtor's lock box, wherein the protective covering protects the adjacent door from being scratched, and incorporates various means for advertising and posting messages. The protective covering is not limited in use to residential dwellings, but is suitable for any premises having lock box arrangement which limits access to the premises.

b) Description of Related Art

At the present time, when a new or unoccupied home is being shown by a realtor, the realtor generally gains access to the home via a lock box which is locked to the doorknob stem on the front door of the home. The lock box itself is a small key safe, which is opened by either another key in the realtor's possession or by one of a number of keyless entry systems which are well known. These boxes, which contain keys to the house, are loosely suspended on the doorknob stem; thus, can swing and scrape the door.

Generally, the lock box itself does not provide any identification of the realtor. Moreover, it is often the case that the listing agent or owner desires to leave a message on behalf of the owner for other realtors who may visit the house. However, the aforementioned lock boxes provide no means by which to post messages or advertisements for other visitors or prospective customers.

Further, many lock boxes in use today operate on a keyless entry system whereby the realtor mounts a keypad to the lock box and enters an electronic code, or inserts an access card to magnetically unlock the lock box. U.S. Pat. No. 4,988,987, which describes such a keyless-entry or electronic-key-operated entry system, is hereby incorporated by reference. While these systems achieve the self same objective as a key, such systems are more susceptible to damage from the elements of nature. The need therefore exists for a protective covering which shields the lock box from environmental conditions which may lead to damage or wear on the lock box, i.e., the exposed electrical contacts on the lock box become coated with debris, or the surface of the lock box becomes unsightly due to wear.

SUMMARY OF THE INVENTION

Accordingly, it is the object of this invention to provide a lock box protector which overcomes the drawbacks mentioned above.

The invention provides a protective covering which overlies and hangs from the lock box to thereby protect the lock box from adverse environmental conditions, while at the same time serving as an abrasion shield to protect the adjacent door from being scratched.

With the design of this invention, means are also provided for posting messages, identifying the realtor by name, and locating business cards.

According to the preferred design of this invention, a flexible and resilient plastic sheet is formed to hang from a realtor's lock box in such a manner that the U-shaped shackle passes through a mid-portion of the sheet, and two hanging flaps extend from this mid-portion to hang on opposite sides of the lock box. The forward flap which extends away from the door is preferably provided with a first window region to receive a realtor's business card, and a second window region for posting messages and/or advertisements, a company logo, etc. The rear flap is interposed between the lock box and the door to protect the door from abrasion.

These and other advantages of the instant invention will become more apparent with reference to the following drawings.

DETAILED DESCRIPTION OF THE PREFERRED EMBODIMENT

Figure 1:
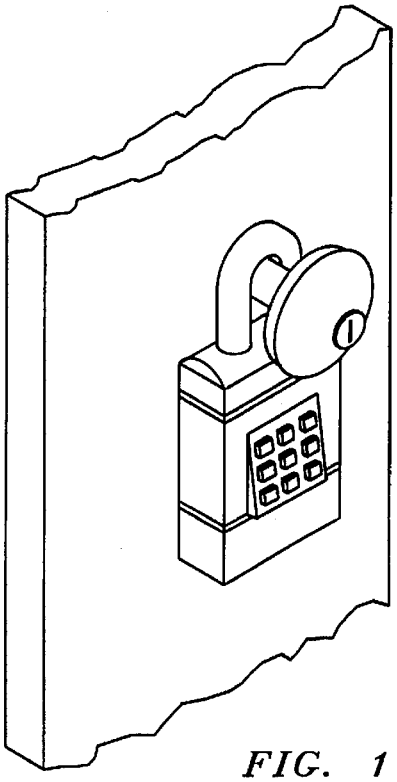
FIG. 1 (PRIOR ART)
FIG. 1 is a perspective view of a conventional lock box to which the present invention is affixed.

One type of lock box suitable for use with the present invention is illustrated as reference numeral 50 in the appended drawings, and FIG. 1 provides an illustration of this conventional lock box. As shown in FIGS. 2–9, the present invention is formed as a protective cover 1 having a top cover portion 10, forward hanging flap 20, and rear hanging flap 30. The protective cover is preferably formed of a resin or polymer material which is washable, waterproof and sufficiently flexible to permit a certain degree of bending. The degree of bending along the cover surface is dependent on the thickness of that portion of the cover. The cover is further suitable to a hostile outdoor environment.

Figure 4:
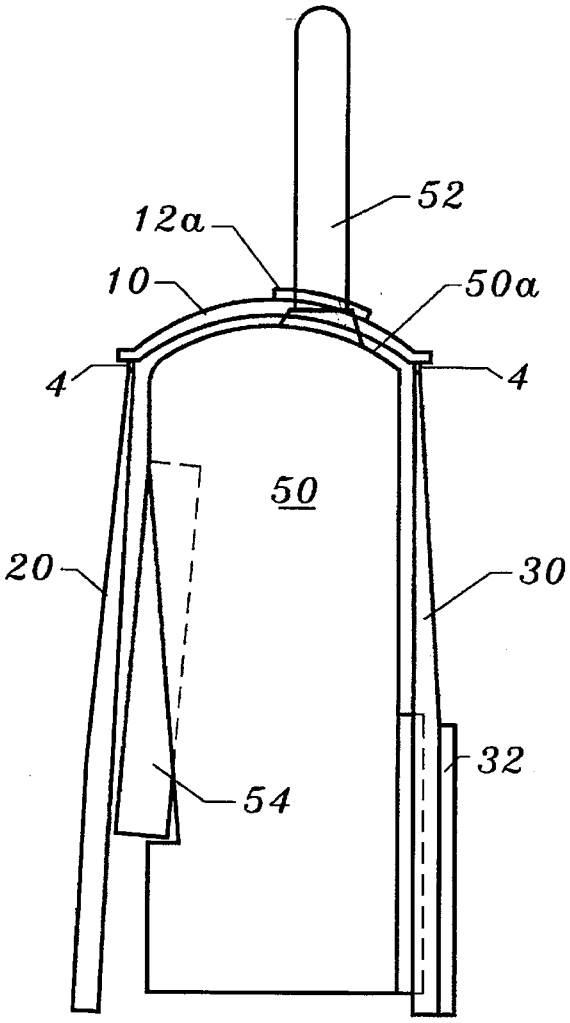
FIG. 4 is a side view of the lock box cover shown in FIG. 2.

The top cover portion 10 of the protective cover 1 is formed as a semi-cylindrical member shaped to conform to the top surface 50*a* of the lock box 50 (see FIG. 4). The top cover portion 10 is provided with two apertures 12 having protective rings 12*a*. The U-shaped shackle 52 passes through both apertures 12, and the top cover portion 10 comes to rest on the top surface 50*a* of the lock box 50. It should be noted that the configuration of the top surface is particularly suited to receive an advertisement, i.e., a sticker may be placed on the top surface adjacent the U-shaped shackle.

Figure 2:
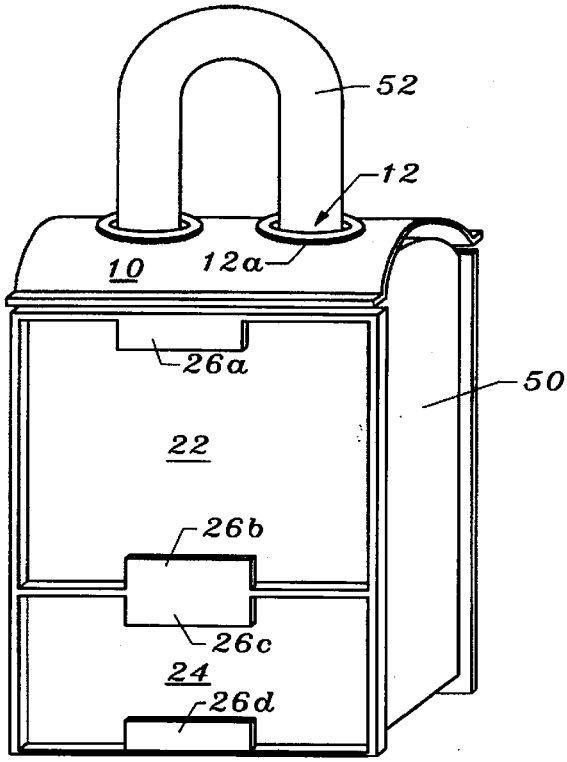
FIG. 2 is a perspective view of the preferred embodiment of the present invention.

The forward and rear hanging flaps 20, 30 are integrally formed with the top cover portion 10 and connected to the top cover portion 10 by a flexible living hinge 4 formed as a narrow strip of plastic having a reduced thickness to increase flexibility (see FIG. 4). The forward hanging flap 20 is provided with display surfaces or posting windows 22, 24 for posting a variety of items; such as business cards, messages, advertisements and the like. To facilitate the posting of business cards or messages, the forward flap 20 is formed with opposing tang members 26*a*, 26*b*, 26*c*, 26*d* which retain the aforementioned card or message on the appropriate display surface of the flap 20. The card or message is simply slid under the opposing tang members 26*a*, 26*b* or 26*c*, 26*d*. As shown in FIG. 2, each posting window 22, 24 is preferably formed as a recessed surface having a border disposed around its circumference.

It should be understood that the posting windows 22, 24 may be formed of a variety of shapes to enhance their message receiving capability; for instance, the lower window 24 may be recessed and sized in the manner shown in FIG. 2 to receive one or more business cards that may be selectively removed. Moreover, the posting windows may be provided with transparent cover plates covering the posting window 22, 24 to thereby protect the underlying message set therein. Finger holes may also be provided in the posting windows to facilitate removal and replacement of messages therein (see finger hole 25 of FIG. 8).

The rear hanging plate 30 hangs from the top cover plate 10 in the same manner as the forward cover plate 20. The rear plate 30 however is formed with contact ribs 32 on the outer surface of the rear plate 30 (see FIGS. 5*a* and 6*a*). The contact ribs 32 abut the door to prevent scratches or the like. These contact ribs 32 may be formed of the same material as the cover 1 or may be formed from a softer material to dampen the contact force when the lock box and cover contact the door. In the preferred embodiment, however, the contact ribs are integrally formed with the remaining cover material.

It is to be noted that the rear flap 30 of the invention may be sized to accommodate various door trim arrangements. For instance, the top portion 10 and/or rear flap 30 may be tapered narrowed in the manner shown in FIG. 6*b* to prevent any interference between the rear flap 30 and the adjacent door trim.

Figure 5A:
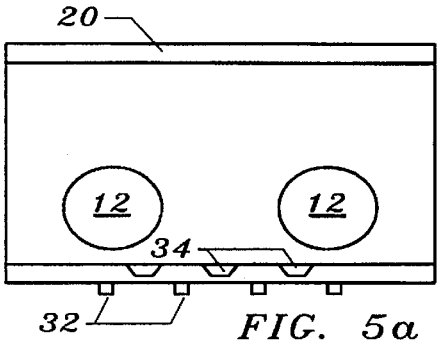
FIG. 5*a* is a bottom view of the lock box cover shown in FIG. 2 absent a lock box.
Figure 5B:
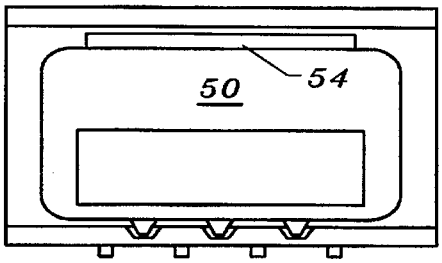
FIG. 5*b* is a bottom view of the lock box cover shown in FIG. 1 with a lock box positioned therein.

The rear plate 30 may also be formed with a contoured inner surface which is formed to match the outer surface of the lock box. For example, as shown in FIG. 5*b*, the inner surface of the rear plate 30 may be formed with recesses 34 which conform to corresponding ribs formed on the lock box. Of course, the particular shape and location of the contoured inner surface will depend on the design of the lock box to be used with the cover.

Figure 7:
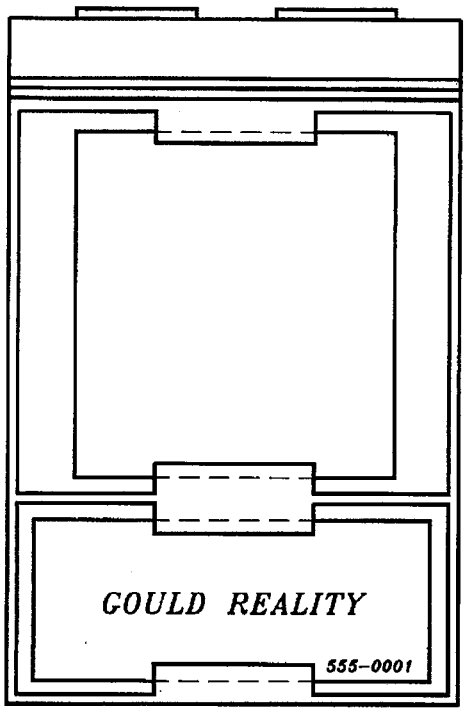
FIG. 7 is a front view of the protective cover of this invention illustrating a business card and message being posted in various window regions of the cover.
Figure 6A:
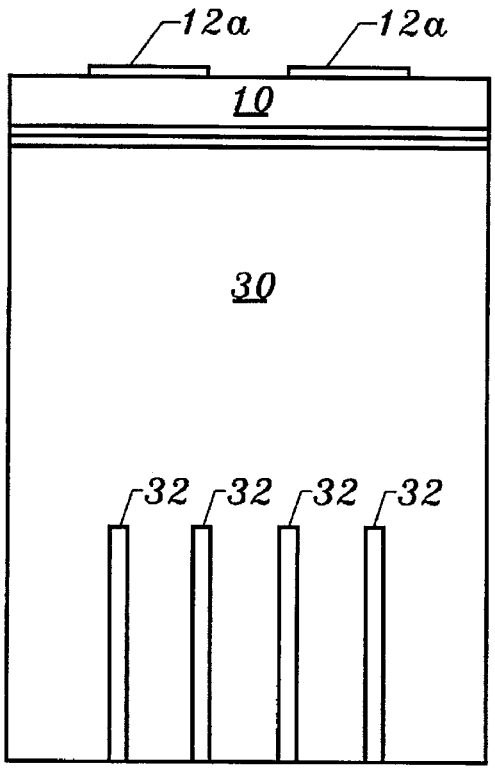
FIG. 6*a* is a rear view of the lock box cover of FIG. 2.
Figure 6B:
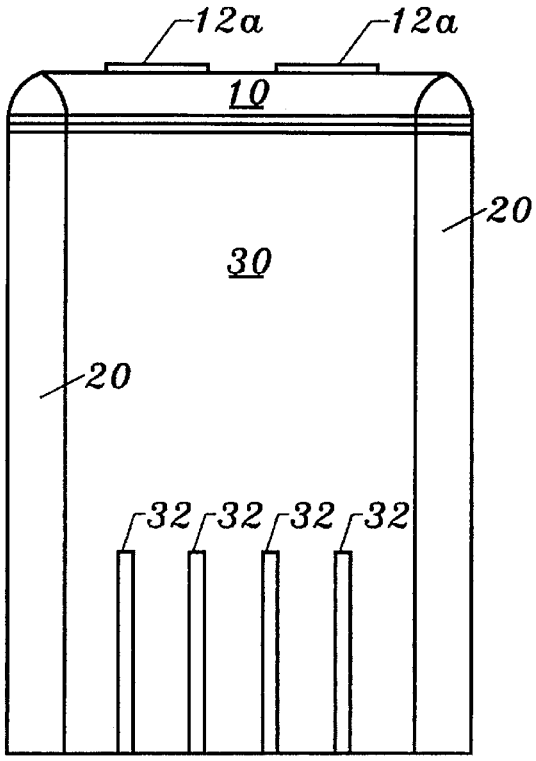
FIG. 6*b* is a rear view of the lock box cover of FIG. 2 according to an alternate embodiment of the invention.

FIG. 7 illustrates the protective cover of the invention with various messages displayed on the posting windows 22, 24; i.e. a business card 24' and a message 22'.

Figure 8:
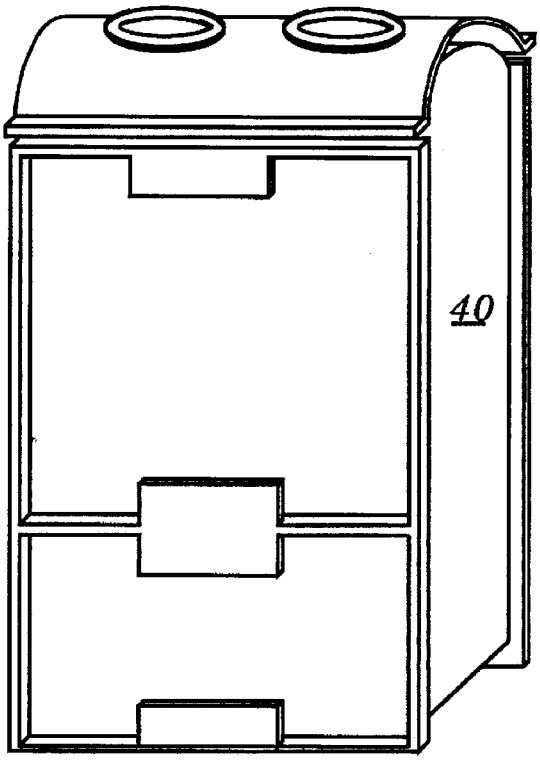
FIG. 8 is a perspective view of a lock box cover according to second embodiment having additional side plates.

FIG. 8 illustrates a second embodiment of the invention wherein the protective cover 1 is formed with additional side plates 40 which extends from the forward hanging plate 20 to the rear hanging plate 30. These additional side plates serve to further protect the lock box from the elements of nature. FIG. 8 also illustrates the finger hole 25 which facilitates ease of removal and replacement of a message, e.g. a business card, from the posting window 24. Of course, an identical finger hole could be provided in posting window 22.

From the foregoing description of this invention, it should be understood that the protective cover is formed to permit easy access to the lock box, and particularly, to the face of the lock box which is opened by a mechanical or electronic key which interacts with the front face of the lock box to gain access to the keys which open the house. To facilitate access to the lock box, the forward flap 20 has a tapered thickness (see FIG. 4). As a result of this tapered thickness, the forward flap 20 will flex or bend more readily at a portion of the flap 20 closer to the hinge 4.

Figure 3:
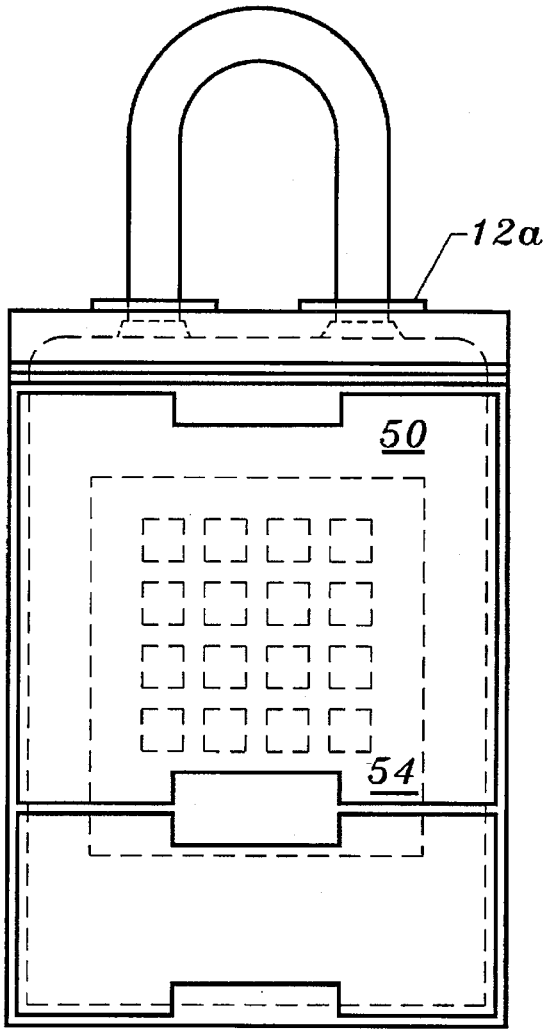
FIG. 3 is a front view of the lock box cover shown in FIG. 2.
Figure 9:
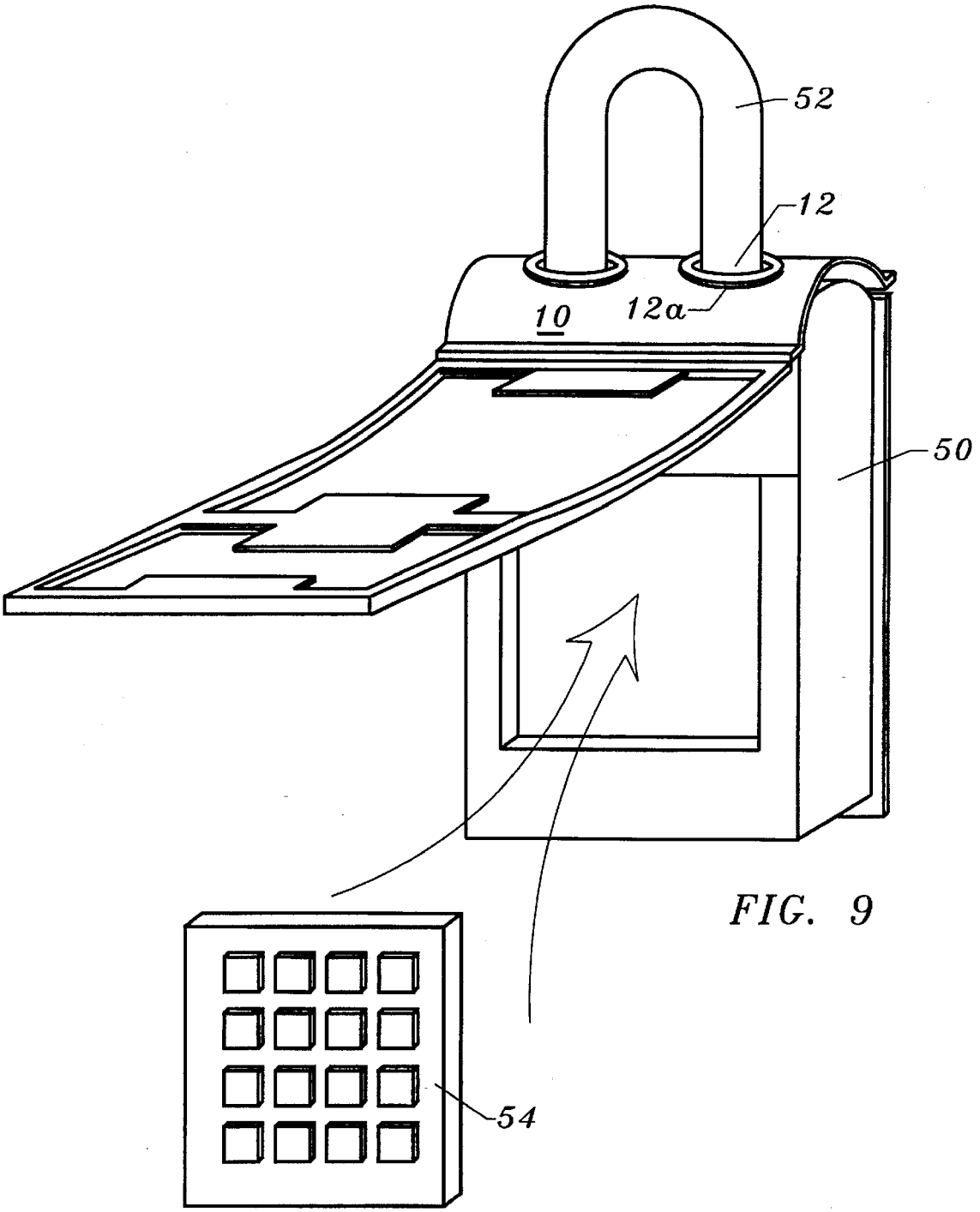
FIG. 9 is a perspective view of the lock box cover of this invention wherein the forward hanging flap is pivoted to exposed the front face of the lock box.

For example, FIGS. 3 and 4 illustrate an electronically operated lock box wherein the keypad 54 is removably attached to face of the lock box. The user merely attaches the keypad 54 to the face of the lock box and enters the proper access code. When the correct access code is entered, the lock box will open to release the keys to the house. FIG. 9 illustrates the pivoting nature of the forward hanging plate 20 which permits the user to gain access to the front face of the lock box by lifting the forward flap 20 away from the lock box, thus, allows the user to attach the keypad 54 to the face of the lock box. Of course, the protective cover of this invention functions in the same manner when used with a lock box operated by a manual key.

While the foregoing invention has been shown and described with reference to attached drawings, it will be understood by those having skill in the art that various changes in form and detail may be made without departing from the spirit and scope of this invention.

I claim:

1. A combination of a protective cover and a lock box containing keys to a premises, said lock box comprising a U-shaped shackle projecting from a top of said lock box, a key retaining interior member which retains the keys to said premises in the interior of said lock box, and an access means for receiving an access key which opens said lock box to thereby release the keys to the premises, said protective cover comprising:

a top portion having at least one aperture for receiving the shackle of the lock box;

a forward hanging first flap hinged to the top portion and elongated in a first direction extending away from said top portion, said first flap comprises a display means disposed on an external surface for posting messages;

a rearward hanging second flap hinged to the top portion and elongated in a second direction extending away from said top portion, wherein said rearward hanging second flap is formed with a contoured inner surface having grooves which matingly engage corresponding ridges on an exterior surface of the lockbox.

2. The protective cover according to claim 1, wherein said top portion is connected to said forward hanging first flap through a hinge means permitting said forward hanging first flap to pivot with respect to said top portion, whereby a user is able to operate said access means by pivoting said forward hanging first flap away from said lock box.

3. The protective cover according to claim 2, wherein said hinge means is integrally formed with said top portion and said first flap.

4. The protective cover according to claim 1, wherein said top portion is formed to overlie the top of the lock box.

5. The protective cover according to claim 1, wherein said top portion evinces a semi-cylindrical shape elongated in a direction transverse to said first and second directions.

6. The protective cover according to claim 1, wherein said at least one surface means comprises a display surface and at least two tangs extending parallel to said display surface to define a gap therebetween, said tangs being located opposite each other with respect to said display surface and extending toward each other.

7. The protective cover according to claim 1, wherein said rearward hanging second flap comprises a plurality of raised protections for reducing an impact force of said protective cover against a door to which the lock box is affixed and for maintaining a separation space between said cover and said door.

8. A protective cover for a lock box containing keys to a premises, said lock box comprising a U-shaped shackle projecting from a top of said lock box, a key retaining interior member which retains the keys to said premises in the interior of said lock box, and an access means for receiving an access key which opens said lock box to thereby release the keys to the premises, said protective cover comprising:

a top portion having at least one aperture for receiving the shackle of the lock box;

at least one hanging flap hinged to the top portion and elongated in a first direction extending away from said top portion, said at least one hanging flap having a generally planar configuration and a material thickness which increases along said first direction, whereby an increased lower thickness maintains said flap in a substantially vertical orientation along said first direction when the protective cover is disposed on said lockbox;

wherein said top portion is connected to said at least one hanging flap through a hinge means permitting said at least one hanging flap to freely pivot with respect to said top portion, whereby a user is able to operate said access means by pivoting said at least one hanging flap away from said lock box.

9. The protective cover according to claim 8, wherein first and second hanging flaps are provided to extend from opposite edges of said top portion.

10. The protective cover according to claim 8, wherein said at least one hanging flap comprises at least one display surface means for receiving and displaying a message thereon.

11. The protective cover according to claim 10, wherein said at least one display surface means comprises a display surface and at least two tangs extending parallel to said display surface to define a gap therebetween, said tangs being located opposite each other with respect to said display surface and extending toward each other.

12. The protective cover according to claim 8, wherein said hinge means is integrally formed with said top portion and said at least one hanging flap.

* * * * *